US009315875B2

(12) United States Patent
Ikeno et al.

(10) Patent No.: US 9,315,875 B2
(45) Date of Patent: Apr. 19, 2016

(54) METHOD OF REFINING MOLTEN IRON

(75) Inventors: Shizuhiko Ikeno, Fukuyama (JP); Yozo Iwaki, Fukuyama (JP); Naotaka Sasaki, Chiba (JP); Takeshi Ishii, Fukuyama (JP); Yuichi Uchida, Chiba (JP); Masanori Nishikori, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 114 days.

(21) Appl. No.: 14/115,125

(22) PCT Filed: Jul. 19, 2012

(86) PCT No.: PCT/JP2012/068349

§ 371 (c)(1),
(2), (4) Date: Nov. 1, 2013

(87) PCT Pub. No.: WO2013/012039

PCT Pub. Date: Jan. 24, 2013

(65) Prior Publication Data

US 2014/0069235 A1 Mar. 13, 2014

(30) Foreign Application Priority Data

Jul. 19, 2011 (JP) ..... 2011-157494
Jan. 19, 2012 (JP) ..... 2012-008807
Mar. 2, 2012 (JP) ..... 2012-046001

(51) Int. Cl.
*C21C 1/02* (2006.01)
*C21C 1/04* (2006.01)
(Continued)

(52) U.S. Cl.
CPC ... *C21C 7/04* (2013.01); *C21C 1/02* (2013.01); *C21C 1/025* (2013.01); *C21C 1/04* (2013.01); *C21C 5/34* (2013.01); *C21C 7/064* (2013.01); *C21C 2005/366* (2013.01)

(58) Field of Classification Search
CPC ..... C21C 1/02; C21C 1/025; C21C 7/064; C21C 1/04
See application file for complete search history.

(56) References Cited

U.S. PATENT DOCUMENTS 5,868,817 A * 2/1999 Yano et al. ..... 75/528

FOREIGN PATENT DOCUMENTS

CN 1470653 A 1/2004
JP A-08-260022 10/1996

(Continued)

OTHER PUBLICATIONS

Kenichiro, M. Japanese Patent No. 2002-256325 A published Sep. 2002. Machine translation of description.*

(Continued)

*Primary Examiner* — George Wyszomierski
*Assistant Examiner* — Tima M McGuthry Banks
(74) *Attorney, Agent, or Firm* — Oliff PLC

(57) ABSTRACT

In a molten iron refining method by charging molten iron and a cold iron source into a converter type refining vessel, supplying a material containing CaO with an oxygen source dissolving the cold iron source and conducting molten iron desiliconization, removing at least a part of the produced slag as an intermediate slag removal, and supplying a slag-forming agent and an oxygen source to the molten iron for dephosphorization, a silicon-containing material or a combination of it and carbonaceous material is added in the desiliconization then carried out under conditions such that the slag basicity (mass % CaO/mass % $SiO_2$) in the desiliconization completion is more than 0.5 but less than 1.5 and a molten iron temperature in the desiliconization completion is more than 1280° C. but less than 1350° C. and more than 30 mass % of the slag produced in the desiliconization is removed from the vessel in the intermediate slag removal.

14 Claims, 6 Drawing Sheets

(51) Int. Cl.

| | |
|---|---|
| ***C21C 7/064*** | (2006.01) |
| ***C21C 7/04*** | (2006.01) |
| ***C21C 5/34*** | (2006.01) |
| *C21C 5/36* | (2006.01) |

(56) References Cited

FOREIGN PATENT DOCUMENTS

| | | | |
|---|---|---|---|
| JP | A-09-176717 | | 7/1997 |
| JP | A-10-152714 | | 6/1998 |
| JP | A-10-265820 | | 10/1998 |
| JP | 2000-178627 | A | 6/2000 |
| JP | 2000-290716 | * | 10/2000 |
| JP | A-2001-271113 | | 10/2001 |
| JP | A-2002-47509 | | 2/2002 |
| JP | A-2002-129221 | | 5/2002 |
| JP | A-2002-241829 | | 8/2002 |
| JP | 2002-256325 | * | 9/2002 |
| JP | A-2002-256325 | | 9/2002 |
| JP | A-2004-190101 | | 7/2004 |
| JP | A-2010-077522 | | 4/2010 |
| JP | A-2011-137196 | | 7/2011 |
| JP | A-2011-149083 | | 8/2011 |

OTHER PUBLICATIONS

Chinese Office Action issued in Chinese Patent Application No. 201280034966.6 on Sep. 2, 2014 (with partial translation).

Okamura et al., "Improvement of the Heat Balance in Combined Blowing Process of the LD Converter," *The Iron and Steel Institute of Japan*, vol. 71, No. 15, pp. 1787-1794, 1985 (With English-language Abstract).

Japanese Office Action issued in Application No. 2013-127076; Dated Aug. 27, 2013 (With Translation).

International Search Report issued in Application No. PCT/JP2012/068349; Dated Oct. 16, 2012 (With Translation).

Jan. 21, 2014 Written Opinion issued in International Patent Application No. PCT/JP2012/068349.

International Search Report issued in International Application No. PCT/JP2013/050742 on Apr. 2, 2013 (with translation).

Written Opinion of the International Searching Authority issued in International Application No. PCT/JP2013/050742 on Apr. 2, 2013 (with translation).

U.S. Appl. No. 14/371,359, filed Jul. 9, 2014 in the name of Yozo Iwaki et al.

Written Opinion of the International Searching Authority issued in International Application No. PCT/JP2012/068349 on Oct. 16, 2012 (with translation).

International Preliminary Report on Patentability issued in International Application No. PCT/JP2013/050742 on Jul. 22, 2014 (with translation).

May 17, 2015 Office Action issued in Korean Application No. 2013-7034480.

Mar. 26, 2015 Office Action issued in Chinese Application No. 201380005806.3.

Sep. 25, 2015 Office Action issued in Korean Application KR2014-7019131.

* cited by examiner

【FIG.5】
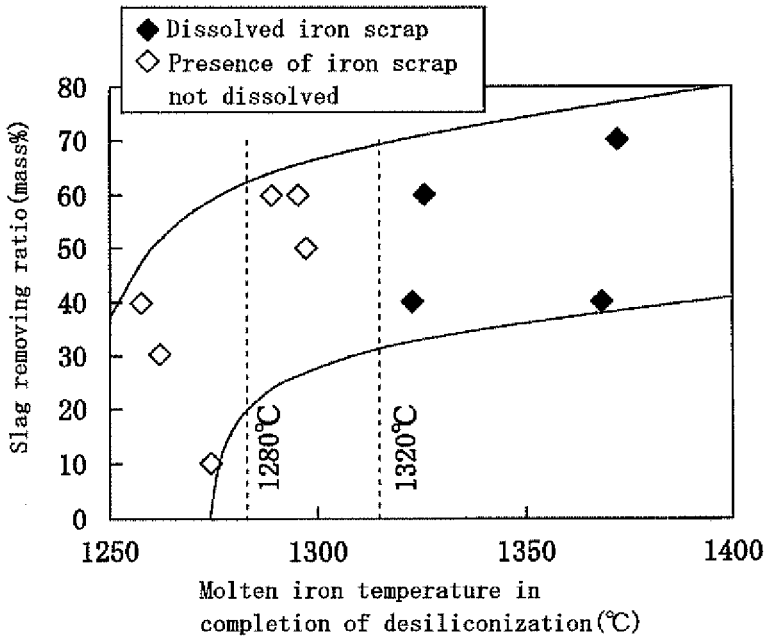
【FIG.6】
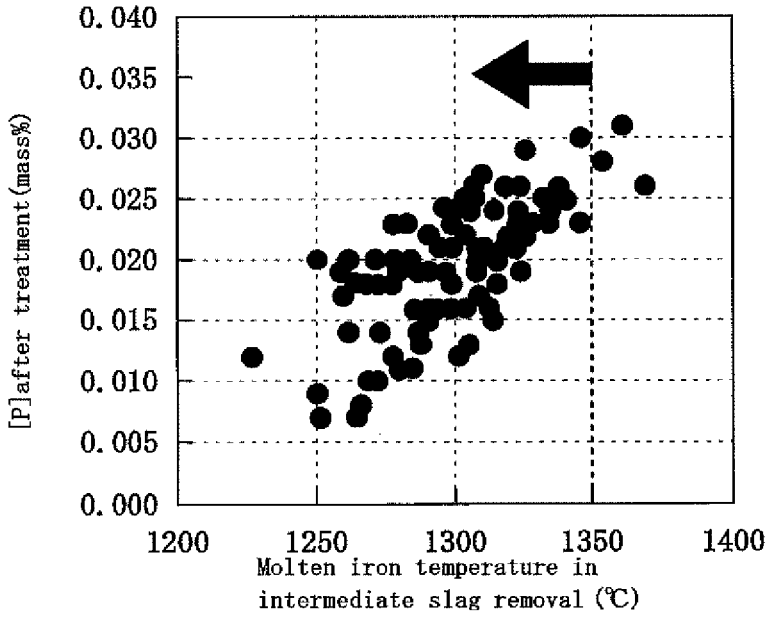

METHOD OF REFINING MOLTEN IRON

TECHNICAL FIELD

This invention relates to a refining method wherein desiliconization and dephosphorization of molten iron are continuously carried out with a single converter type refining vessel (converter type refining furnace) including a slag removing step (intermediate slag removal) on the way, and more particularly to a method of refining molten iron wherein a cold iron source such as iron scrap, cold iron or the like can be dissolved efficiently.

RELATED ART

Recently, it is strongly demanded to reduce an emission amount of a greenhouse gas. In the steel industry, therefore, if there is a thermal room in the molten iron during the dephosphorization treatment and decarburization refining of the molten iron in a converter, energy required for the production of steel products is reduced by compounding a cold iron source such as iron scrap or the like into the molten iron inside the converter. Since the cold iron source, or metallic iron, is not necessary to be reduced different from iron oxide such as iron ore charged into a blast furnace, molten steel can be produced in energy consumption and greenhouse gas emission smaller than those in the production of molten steel by refining a pig iron tapped from the blast furnace. Also, the molten steel is produced by adding the cold iron source to the molten iron produced in the blast furnace, whereby molten steel can be produced in an amount larger than the amount of the molten iron produced in the blast furnace, so that it is possible to increase the production amount of the molten steel.

Lately, a refining method previously removing phosphorous in the molten iron is conducted by carrying out dephosphorization as a preliminary treatment to the molten iron before the decarburization refining in the converter (which may be called as "preliminary dephosphorization"), which is advantageous in view of the cost and quality. This is based on the fact that the dephosphorization refining can be conducted with a small amount of a refining agent because the dephosphorization reaction is thermodynamically likely to proceed as the refining temperature becomes lower or the dephosphorization reaction is easily proceeding in the molten iron stage rather than in the molten steel stage.

In the typical preliminary treatment of the molten iron, a solid oxygen source such as iron oxide or the like is first added to the molten iron to conduct desiliconization, and thereafter a slag generated by the desiliconization is removed, and then a dephosphorization refining agent (solvent) is added after the molten iron is transferred to another refining vessel, if necessary, to conduct dephosphorization. In general, CaO based solvent such as quicklime or the like is used as a dephosphorization refining agent for the above dephosphorization and a solid oxygen source (iron oxide or the like) or a gaseous oxygen source (oxygen gas or the like) is used as an oxygen source for the dephosphorization. As a refining vessel for conducting the preliminary treatment are used a torpedo car, a ladle (blast furnace ladle, charging ladle), a converter type refining furnace and so on.

The molten iron after the dephosphorization by the above method causes a problem that since silicon (Si) as a heat source is substantially consumed by oxidation and also carbon (C) is oxidized to decrease carbon concentration by about 1.5% by mass (% by mass is referred to as "mass %" hereinafter) as compared with that in the tapping and hence there is no thermal room for dissolving the cold iron source such as iron scrap or the like, the cold iron source cannot be compounded at the decarburization refining step in the converter of the molten iron subjected to dephosphorization. To this end, in case of requiring the increased production of the molten steel, an operation returning to the conventional blowing into the converter may be carried out by throwing up the dephosphorization as the preliminary treatment and simultaneously conducting the dephosphorization refining and the decarburization refining in the converter.

However, not only the reduction of the cost and the improvement of the quality of the steel material can be attained but also the amount of slag generated can be reduced by the dephosphorization, so that it is desired that the dephosphorization of the molten iron is conducted as mentioned above without conducting the above change of the operation mode and only the decarburization refining is further conducted in the converter and at the same time a compounding ratio of the cold iron source such as iron scrap or the like is increased, whereby the molten steel is produced in an amount larger than that of the molten iron per unit mass produced in the blast furnace.

In the decarburization refining of the molten iron in the converter, it has hitherto been attempted to add ferrosilicon (Fe—Si), metallic Al or a carbonaceous material such as coke, coal, graphite or the like as a heat source and oxidize such a heat source with an oxygen gas supplied to ensure an end temperature for the decarburization refining utilizing the resulting oxidation heat. Although it is possible to increase the compounding ratio of the cold iron source by adding such a heat source, the ferrosilicon and metallic Al are expensive because they are manufactured by using a large amount of an electric power, so that the addition thereof is not industrially possible only by the merit that the compounding of the cold iron source can be increased. Also, the use of the ferrosilicon or metallic Al forms $SiO_2$ or $Al_2O_3$ to obstruct the refining, so that it is necessary to dilute the resulting $SiO_2$ or $Al_2O_3$, and hence the amount of CaO based solvent used is increased to cause the rise of production cost.

Furthermore, molten iron existing in the converter itself is considered to be used as an inexpensive heat source. Since the amount of heat generation converted per 1 kg of oxygen reacting with iron (Fe) is near to that of ferrosilicon, it is possible to efficiently utilize a blowing oxygen gas as compared with the carbonaceous material such as coke, graphite or the like. However, when iron is oxidized, there is a problem that erosion of a refractory becomes vigorous because FeO concentration in the slag is as high as not less than 35 mass % in a decarburization refining of removing carbon in the molten iron by supply of oxygen gas. Also, oxidation of iron becomes large, so that such a use is not established industrially.

On the other hand, the carbonaceous material is frequently used as a heat source because it is inexpensive. However, coke or anthracite used as the carbonaceous material for the heat source is small in the amount of heat generation per unit mass as compared to ferrosilicon or metallic Al. In order to compensate the same heat amount, the carbonaceous material is necessary to be used in a greater amount and also a greater amount of oxygen gas is required to be additionally added for combustion of this carbonaceous material, which leads to prolong the blowing time in the converter and there is a fear of rather lowering the productivity in the converter even if the ratio of the cold iron source compounded is increased. In addition, sulfur included in the coke or anthracite is incorporated into the molten iron or molten steel to cause pickup of the sulfur concentration in the molten iron or molten steel, which is necessary to use desulfurization treatment after tapping from the converter when low-sulfur steel is particularly produced and is also a cause of increasing the production cost.

Also there is performed a method wherein CO gas generated through decarburization reaction during the decarburization refining is secondarily burnt in the converter ($2CO+O_2 \rightarrow 2CO_2$) and heat generation by this secondary combustion is absorbed in molten steel to increase dissolving amount of the cold iron source (for example, see Tetsu-to-Hagane, vol. 71 (1985), No. 15. p. 1787-1794). In the usual decarburization refining, however, the heat storing efficiency in molten metal is low and only a lining refractory in the converter is heated and most part of secondary combustion heat is discharged out from the converter, so that there is a problem of enlarging the damage of the lining refractory in the converter. In this method, there is a limit for making the compounding ratio of the cold iron source higher.

For the purpose of raising the heat storing efficiency of the secondary combustion heat to dissolve a large amount of the cold iron source with a small amount of the carbonaceous material used, JP-A-H08-260022 proposes a method wherein a large amount of slag is formed in the converter in an amount of not less than 100 kg but not more than 1000 kg per 1 ton of molten iron inside the converter and secondary combustion is conducted in the slag.

Also, JP-A-H10-265820 proposes a method wherein slag is formed in the converter in an amount of not less than 100 kg but not more than 400 kg per 1 ton of molten iron and secondary combustion is conducted in the slag and at the same time the slag is strongly agitated by an agitating gas blown from a bottom blowing tuyere.

In the methods disclosed in the above documents, however, the carbonaceous material should be convoluted into the slag after ensuring the slag amount of not less than 100 kg per 1 ton of molten iron in the converter, which means that the ratio of the foaming slag occupied in the volume of the converter is made higher. As a result, it is required to significantly decrease the amount of molten iron to be housed in the converter for avoiding blowout of the slag from a throat of the converter during the blowing, so that there is a problem that the dissolving efficiency of the cold iron source is finally decreased.

On the other hand, JP-A-H09-176717 proposes a method of manufacturing steel from a blast furnace molten iron through a converter, which comprises a first step of charging molten iron tapped from a blast furnace into a top and bottom blown converter to conduct desiliconization and removing the resulting desiliconized slag, a second step of subjecting the molten iron left in the converter after the desiliconization to dephosphorization and desulfurization and a third step of tapping the dephosphorized and desulfurized molten iron from the converter to a hot metal ladle and charging into another available top and bottom blown converter to conduct decarburization in such a converter.

According to the method disclosed in JP-A-H09-176717, it is said that the cold iron source may be dissolved by utilizing an oxidation combustion heat of silicon in the molten iron during the desiliconization, but there is a limit in the amount of the cold iron source dissolved only by the combustion heat of silicon included in the molten iron, so that there is still a room for improvement from a viewpoint of increasing the compounding ratio of the cold iron source.

Heretofore, the use of iron oxide is common in the desiliconization conducted as a part of a pretreatment for the molten iron in order to avoid operational troubles through slag foaming in the molten iron vessel and to supply a large amount of oxygen in a short time.

For example, there is a desiliconization method wherein iron oxide as an oxygen source for desiliconization is blown into the molten iron together with a carrier gas in desiliconization reaction at an initial stage of the pretreatment of the molten iron. In this method, however, the iron oxide is endothermically decomposed during the progression of reduction reaction, and hence the combustion heat of silicon in the molten iron cannot be efficiently converted to heat for dissolving scrap and the temperature rise of the molten iron is not obtained sufficiently at the stage of desiliconization reaction.

SUMMARY OF THE INVENTION

Task to be Solved by the Invention

As mentioned above, there are many proposals for the purpose of manufacturing more molten steel from molten iron per unit mass produced by conducting desiliconization and dephosphorization as a pretreatment of molten iron and further conducting decarburization refining in a converter and at the same time increasing a compounding ratio of a cold iron source such as iron scrap or the like in a blast furnace, but an effective means has not been actually proposed until now.

The invention is made in view of the above situation and is to provide a method of refining molten iron wherein thermal compensation for dissolving the cold iron source such as iron scrap or the like can be conducted in a short time efficiently and inexpensively without requiring a lot of equipment and energy inherent to the molten iron is effectively utilized in the dissolution of the cold iron source with economy and sufficient refining of the molten iron (desiliconization, dephosphorization) can be carried out in consideration of the cost and quality.

Solution for Task

In order to solve the above task, the summary of the invention is as follows.

That is, the invention is a method of refining molten iron by charging molten iron and a cold iron source into a converter type refining vessel, supplying an auxiliary material containing CaO as a main component together with an oxygen source to dissolve the cold iron source and at the same time conduct desiliconization of the molten iron, removing at least a part of slag produced by the desiliconization as an intermediate slag removal, and subsequently supplying a slag-forming agent and an oxygen source to the molten iron in the converter type refining vessel to conduct dephosphorization, characterized in that a silicon-containing material or a combination of a silicon-containing material and a carbon material is added as a heat source to the converter type refining vessel in the desiliconization and then the desiliconization is carried out under conditions that a basicity of the slag (mass % CaO/mass % $SiO_2$) in the completion of the desiliconization is not less than 0.5 but not more than 1.5 and a molten iron temperature in the completion of the desiliconization is not lower than 1280° C. but not higher than 1350° C. and then not less than 30 mass % of the slag produced in the desiliconization is removed from the converter type refining vessel in the intermediate slag removal.

In the refining method of the molten iron comprising the above construction, as a concrete means for solving the above task are preferable the followings:

1) an additive amount of at least one of the auxiliary material containing CaO as a main component and the silicon-containing material is adjusted so as to render the basicity of the slag (mass % CaO/mass % $SiO_2$) in the completion of the desiliconization into a range of not less than 0.5 but not more than 1.0;

2) an amount of the oxygen source supplied is adjusted to render the molten iron temperature in the completion of the desiliconization not lower than 1320° C.;

3) a total amount of non-oxide silicon in the silicon-containing material charged into the converter type refining vessel or added in the desiliconization is made to a range of 4~10 kg/t per total mass of the molten iron and cold iron source charged into the converter type refining vessel;

4) a unit consumption $X_s$ (kg/t) of the cold iron source per total mass of the cold iron source and molten iron charged into the converter type refining vessel is a range of not less than 220 but not more than 260 as a value of Y calculated by the following equation (1) and the molten iron temperature in the completion of the desiliconization is not lower than 1280° C. but not higher than 1320° C.:

$$Y=(3+34.5[\%\ Si]+0.21T_i)\cdot(1000-X_s)/1000 \quad (1)$$

wherein [% Si]: concentration of silicon in molten iron charged (mass %)

$T_i$: temperature of molten iron charged (° C.)

$X_s$: unit consumption of cold iron source (kg/t);

5) a slag removing ratio of the slag removed from the converter type refining vessel in the intermediate slag removal is 60~90 mass % of the slag produced in the desiliconization;

6) a slag amount of the slag in the converter type refining vessel after the intermediate slag removal is not less than 4 kg/t but not more than 20 kg/t;

7) an amount of oxygen supplied to the molten iron other than oxygen consumed for oxidation of silicon in the desiliconization is not less than 2 $Nm^3$/t as a unit consumption per total mass of the molten iron and cold iron source charged into the converter type refining vessel;

8) the cold iron source is at least one selected from iron scrap or direct reduced iron and cold iron;

9) a time ranging from the completion of the desiliconization to the removal of desiliconized slag is not more than 4 minutes;

10) the auxiliary material containing CaO as a main component is at least one selected from a converter slag and slag (ladle slag) produced in the practice of ladle refining;

11) as the silicon-containing material is used an auxiliary material composed mainly of silicon carbide;

12) the auxiliary material composed mainly of silicon carbide is SiC briquette and/or SiC based waste refractory containing SiC as a main component;

13) an addition amount of the SiC briquette and/or the SiC based waste refractory is not more than an upper addition limit W calculated from the following equation (2):

$$W=(F-600)\times 0.3\div 22.4\times 28\div X_{si}\div 10 \quad (2)$$

wherein W: upper limit of addition amount of SiC briquette and/or SiC based waste material (ton)

F: total oxygen amount supplied in desiliconization ($Nm^3$)

$X_{si}$: Si content (mass %) contained as SiC in SiC briquette or SiC based waste refractory.

Effect of the Invention

According to the refining method of molten iron comprising the above construction of the invention, the combustion heat of silicon in the silicon-containing material (silicon source) added to the molten iron in the desiliconization is positively utilized as a thermal compensation for dissolving the cold iron source such as iron scrap or the like and the desiliconization and dephosphorization are continuously carried out in the same converter type refining vessel across the intermediate slag removal, so that it is possible to efficiently dissolve a large amount of the cold iron source in a short time.

Also, according to the refining method of molten iron of the invention, the desiliconization is carried out in the converter type refining vessel, so that there is a room in the volume of the vessel and operative troubles are not caused by the slag foaming but also a large amount of gaseous oxygen can be supplied to the molten iron in a short time without using iron oxide and it is possible to utilize the combustion heat of silicon in the dissolution of the cold iron source without being consumed as a decomposition heat of iron oxide.

Furthermore, according to the refining method of molten iron of the invention, the dephosphorization is carried out following to the desiliconization, so that heat amount dissipated to the atmosphere in the translocation of the vessel and heat amount absorbed by the refractor can be utilized as a heat for dissolving the cold iron source.

Moreover, by the intermediate slag removal conducted between the desiliconization and the dephosphorization is discharged out a slag having a low basicity (mass % CaO/mass % $SiO_2$=0.5~1.5) generated in the desiliconization from the converter type refining vessel to thereby reduce the amount of the slag with the low basicity remaining in the vessel, whereby the amount of CaO (CaO based slag forming agent) used to be added and charged for conducting sufficient dephosphorization at a last half dephosphorization required with a high basicity (=1.5~3.0) can be reduced.

BRIEF DESCRIPTION OF THE DRAWINGS

FIG. 5 is a graph showing results studied on a relation among presence or absence of undissolved cold iron source at a time of completing desiliconization, and molten iron temperature and slag removing ratio in completion of desiliconization.

FIG. 6 is a graph showing molten iron temperature in intermediate slag removal and phosphorus concentration after dephosphorization.

EMBODIMENTS FOR CARRYING OUT THE INVENTION

The invention will be described concretely with reference to the drawings below.

Figure 1:
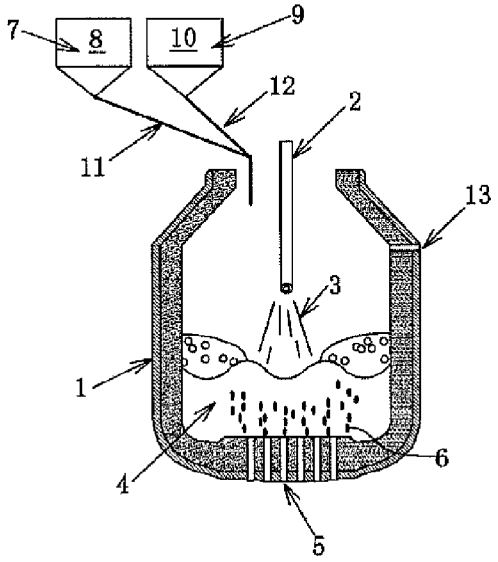
FIG. 1 is a schematic view illustrating a section of a converter type refining vessel suitable for refining molten iron according to the invention.
Figure 2:
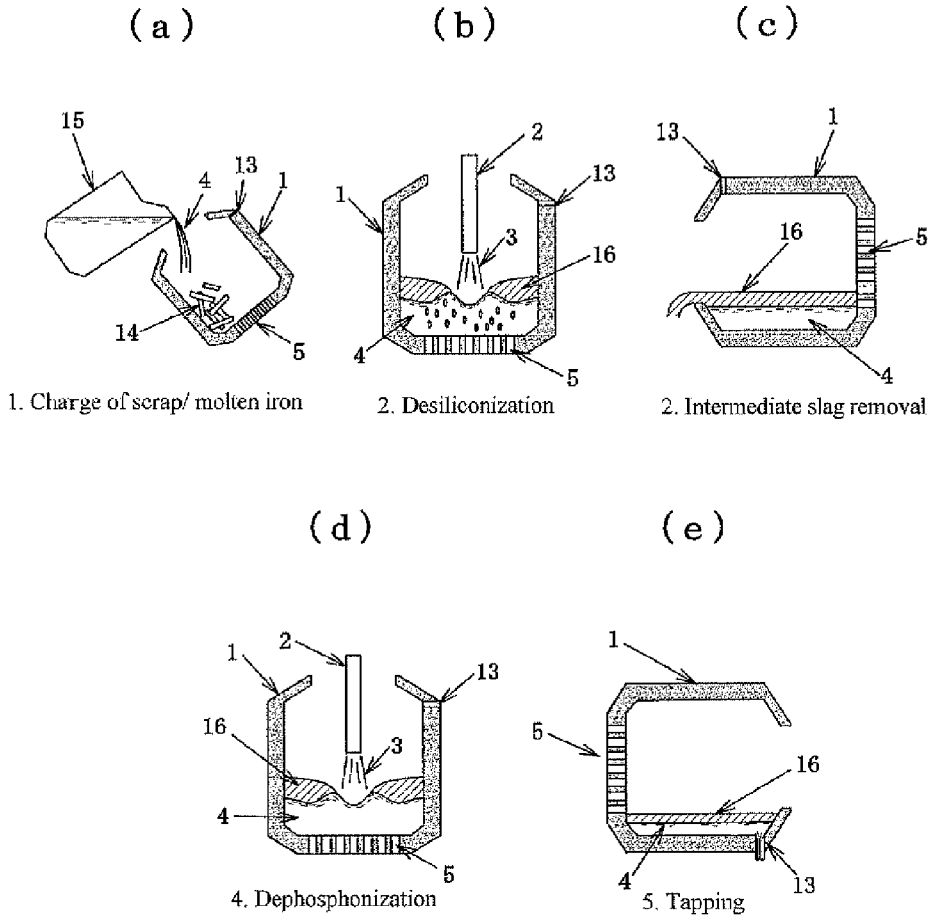
FIGS. 2(*a*)~(*e*) are schematic views illustrating a sequence of refining process demanded by the invention, respectively.

FIG. 1 is a schematic view illustrating a section of a converter type refining vessel suitable for use in the refining of molten iron according to the invention, and FIGS. 2(*a*)~(*e*) are schematic views illustrating a sequence of refining process of molten iron according to the invention, respectively. Moreover, FIG. 1 is a view illustrating a desiliconization step of FIG. 2(*b*).

In the refining method of molten iron according to the invention can be used a top and bottom blowable converter type refining vessel (converter) 1 as shown in FIG. 1.

The top blowing is carried out by supplying oxygen gas 3 through a top blowing lance 2 capable of going up and down in an interior of the converter type refining vessel 1 and toward molten iron 4 from a tip of the top blowing lance 2. The oxygen gas 3 is an industrial pure oxygen.

Also, the bottom blowing is carried out through bottom blowing tuyeres (bottom blowing nozzles) 5 disposed in the bottom of the converter type refining vessel 1.

A gas 6 for bottom blowing is blown into the molten iron 4 to strengthen agitation of the molten iron 4 and has a function of promoting dissolution of a cold iron source, so that it may be a gas containing an oxygen gas or an inert gas such as argon gas, nitrogen gas or the like.

Also, the gas 6 for bottom blowing may have a function of blowing a flux (slag forming agent) into the molten iron together with a carrier gas (transportation gas).

In FIG. 1, numeral 7 is a hopper housing a silicon-containing material (hereinafter referred to as "silicon source") 8, numeral 9 is a hopper housing an auxiliary material containing CaO as a main component (hereinafter referred to as "CaO based solvent) 10, numeral 11 is a chute for charging the silicon source 8 housed in the hopper 7 into the converter type refining vessel 1, numeral 12 is a chute for charging the CaO based solvent 10 housed in the hopper 9 into the converter type refining vessel 1, and numeral 13 is a tapping port for tapping the molten iron 4 from the converter type refining vessel 1 after the refining.

In the refining method of the molten iron 4 according to the invention are used two or more top and bottom blowable converter type refining vessels 1 having the above construction, in which at least one of the converter type refining vessels 1 can conduct desiliconization and dephosphorization (pretreatment) of the molten iron 4, and at least remaining one can conduct decarburization of the pretreated molten iron 4. That is, the desiliconization and dephosphorization of the molten iron 4 are conducted in the converter type refining vessel(s) 1 for the pretreatment of the molten iron, and then the molten iron 4 subjected to the pretreatment for molten iron is transferred to the converter type refining vessel(s) 1 for decarburization to conduct the decarburization.

In the refining of the molten iron 4, as shown in FIG. 2(*a*), a cold iron source 14 such as iron scraps or the like is first charged into the converter type refining vessel 1 and then the molten iron 4 is charged through a charging ladle 15.

Next, the silicon source 8 housed in the hopper 7 and the CaO based solvent 10 housed in the hopper 9 are added to the molten iron 4 inside the converter type refining vessel 1 through the chutes 11 and 12, respectively, and thereafter oxygen gas or iron oxide is supplied as an oxygen source to conduct desiliconization as shown in FIG. 2(*b*).

In the desiliconization of the molten iron 4, silicon contained in the silicon source 8 and silicon contained in the molten iron 4 are reacted with oxygen in the oxygen source ($Si+2O \rightarrow SiO_2$) to generate oxidation heat, and the molten iron temperature is raised by the oxidation heat to promote dissolution of the cold iron source 14 in the molten iron.

As the cold iron source previously charged into the converter type refining vessel 1 may be a source containing iron as a main component such as direct reduced iron, cold molten iron or the like in addition to iron scrap defined in "Uniform standards of ferrous scraps" of the Japan ferrous raw materials association.

As the oxygen source for desiliconization may be only the oxygen gas 3 supplied from the top blowing lance 2 or iron oxide (not shown) may be used together with the oxygen gas 3.

In order to form a slag 16 having a target basicity (mass % CaO/mass % $SiO_2$) (which may be simply represented as "basicity" hereinafter) during desiliconization conducted for a short time, it is considered to be effective to partly use the iron oxide having a function of promoting the formation of slag from the CaO based solvent 10, but it cannot be said that the use of the iron oxide absorbing heat in the heat rise and the decomposition is preferable from a viewpoint of dissolving a large amount of the cold iron source 14 as an object of the invention. Therefore, it is desirable to use only the oxygen gas 3 without using the iron oxide as the oxygen source.

Since the converter type refining vessel 1 is used as a refining vessel, strong agitation is possible, so that it is confirmed that the slag 16 having a target basicity can be sufficiently formed even when the desiliconization is carried out by using only the oxygen gas.

Moreover, the charging of the CaO based solvent 10 may be done after the start of the desiliconization, but a faster timing is desirable as early as possible in order to sufficiently form the slag 16 during the desiliconization in a short time, so that it is preferable to previously charge the CaO based solvent 10 into the converter type refining vessel 1 together with the cold iron source 14.

The use of the CaO based solvent 10 in the desiliconization is to adjust the basicity of the resulting slag 16. As the CaO based solvent 10 may be used quicklime (CaO), limestone ($CaCO_3$), calcium hydroxide ($Ca(OH)_2$), light burnt dolomite, green dolomite and so on. The CaO content is preferably not less than 30 mass %, more preferably not less than 60 mass %. Further, a slag produced during the decarburization refining of molten iron in the converter (converter slag), a slag produced during the refining of molten iron (decarburization) using the converter type refining vessel 1 (converter slag), and a slag produced during the refining in a ladle (ladle slag) can be also used. The converter slag and ladle slag have a basicity of 3~5 and sufficiently function for adjusting the basicity of the resulting slag 16.

In the invention, a silicon source 8 having a large amount of heat generation is charged into the converter type refining vessel 1 as a heat source for dissolving a large amount of the cold iron source 14 in a short time. As the silicon source 8 may be used ferrosilicon (Fe—Si) and metallic silicon.

As the silicon source 8 is used an auxiliary material consisting essentially of silicon carbide. Concretely, it is preferable to use less expensive SiC briquette consisting essentially of SiC or SiC based waste refractory consisting essentially of SiC.

The term "SiC based waste refractory" used herein means SiC refractories not utilized effectively until now, for example, a spent SiC based refractory, ones generated as surplus materials in the construction of the SiC based refractory and so on. As the heat source, it is not necessary to use only the silicon source 8 alone, so that it may be used together with another heat source such as carbonaceous material, metallic Al or the like. Especially, since the carbonaceous material is inexpensive, it is preferable to use the carbonaceous material in addition to the silicon source 8.

In the refining method of the molten iron 4 according to the invention, intermediate slag removal is conducted after the desiliconization as shown in FIG. 2(*c*), whereby a low basicity slag 16 containing a large amount of $SiO_2$ generated in the desiliconization is discharged from the converter type refining vessel 1. In this case, the addition amount of at least one of the CaO based solvent 10 and the silicon source 8 is adjusted in the desiliconization so that the basicity of the slag 16 to be discharged is within a range of 0.5~1.5.

As the amount of the CaO based solvent 10 used becomes large, the basicity rises, whereas as the amount of the silicon source 8 used becomes large, the basicity lowers.

In the desiliconization, also, the amount of the silicon source 8 supplied is adjusted so that the molten iron temperature in the completion of the desiliconization is not lower than 1280° C. for making a temperature of the slag 16 discharged not lower than 1280° C. As the amount of the silicon source 8 supplied becomes larger, the molten iron temperature rises. Moreover, the temperature of the slag 16 is equal to or higher than the temperature of the molten iron 4 (the silicon source 8 is frequently burnt in the slag, so that combustion heat of the silicon source 8 is absorbed in the slag 16), so that it is confirmed that when the temperature of the slag 16 is not lower than 1280° C., the temperature of the molten iron 4 is not lower than 1280° C.

The reason why the basicity of the slag 16 and the temperature of the molten iron 4 are adjusted to the above ranges in the invention is based on the fact that good slag removing property and slag removing ratio (slag removing ratio (mass %)=(slag mass discharged)/(slag mass generated in desiliconization)×100) are obtained while ensuring the flowability of the slag 16.

Figure 3:
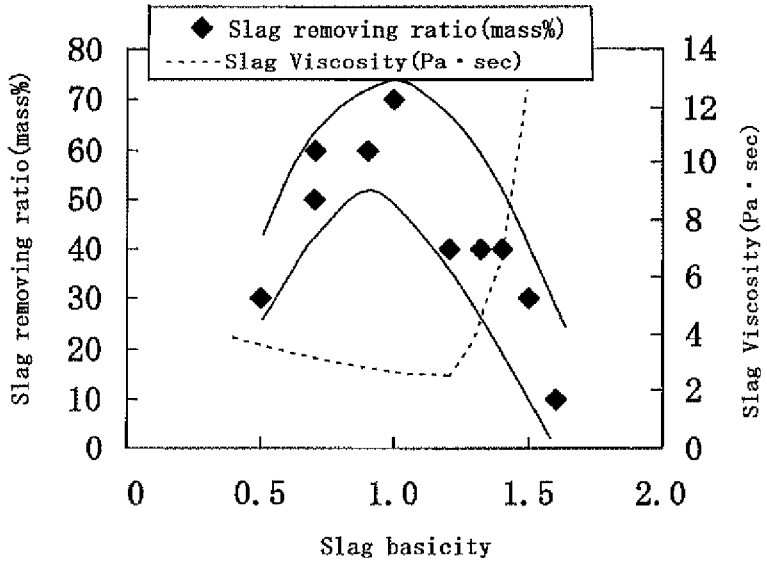
FIG. 3 is a graph showing a relation among slag basicity, slag removing ratio and slag viscosity.

FIG. 3 is a graph showing a relation among slag basicity, slag removing ratio and slag viscosity. As shown in FIG. 3, when the basicity of the slag 16 is less than 0.5, the viscosity of the slag 16 becomes higher and good slag removing ratio cannot be obtained. On the other hand, when the basicity of the slag 16 exceeds 1.5, solid phase slag is caused and the flowability of the slag 16 becomes low and the slag removing ratio decreases. In the invention, therefore, the basicity of the slag 16 is not less than 0.5 but not more than 1.5. Thus, the basicity of the slag 16 is enough to be a range of 0.5~1.5 from a viewpoint of ensuring the slag removing property and the slag removing ratio of the slag 16, but the basicity of the slag 16 is preferable to be adjusted to a range of 0.5~1.0 from a viewpoint of reducing the amount of the CaO based solvent 10 used in the desiliconization.

Figure 4:
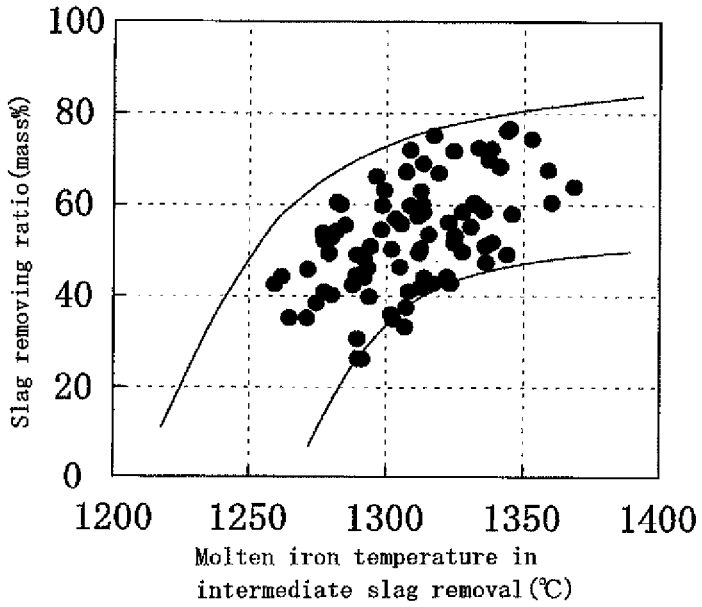
FIG. 4 is a graph showing a relation between temperature of molten iron during intermediate slag removal and slag removing ratio.

When the temperature of the slag 16 is lower than 1280° C., the rise of slag viscosity through solid phase slag and the rise of viscosity through liquid phase slag are caused and hence the flowability of the slag 16 becomes lower and as shown in FIG. 4, the slag removing ratio of the slag 16 is decreased. Therefore, the case that the temperature of the slag 16 is lower than 1280° C. is caused depending upon the initial condition of the molten iron 4 used, for example, even at a stage that silicon concentration in the molten iron is less than 0.05 mass % with progression of the desiliconization. In this case, it is necessary that desiliconization reaction is further promoted to ensure the molten iron temperature of not lower than 1280° C.

FIG. 5 is a graph showing results studied on a relation among presence or absence of undissolved cold iron source 14 at a time of completing the desiliconization, molten iron temperature in the completion of the desiliconization, and slag removing ratio. As shown in FIG. 5, the molten iron temperature in the completion of the desiliconization is preferably not lower than 1320° C. from a viewpoint of promoting the dissolution of the cold iron source 14.

On the other hand, when the temperature of the molten iron 4 in the intermediate slag removal exceeds 1350° C., the molten iron temperature after the dephosphorization becomes higher and phosphorus concentration in the molten iron 4 is not less than 0.030 mass %, which causes the increase of CaO source required in the decarburization refining.

This results from the fact that even if the charging time of the auxiliary material (slag forming agent) in the dephosphorization is shortest, oxygen is supplied for dissolving the auxiliary material and hence the temperature of the molten iron 4 after the dephosphorization rises inevitably.

An interrelation between the molten iron temperature during the intermediate slag removal and the phosphorus concentration in the molten iron 4 after the dephosphorization is shown in FIG. 6. As seen from FIG. 6, the molten iron temperature during the intermediate slag removal is desirable to be not higher than 1350° C. for progressing dephosphorization reaction.

When the molten iron temperature during the intermediate slag removal exceeds 1350° C., magnesia concentration and basicity in the slag are necessary to be increased in order to prevent wear damage of lining magnesia-carbon bricks and hence there is a problem of increasing the cost. In the invention, therefore, the molten iron temperature in the completion of the desiliconization is made to not higher than 1350° C.

In the desiliconization, a total amount of non-oxide silicon (silicon being not an oxide, hereinafter referred to silicon simply) of the silicon source 8 charged into the converter type refining vessel 1 or added during the desiliconization is preferable to be a range of 4~10 kg/t per total mass of the molten iron 4 and the cold iron source 14 charged into the converter type refining vessel 1.

When the total amount of silicon added exceeds 10 kg/t, an amount of silicic acid formed in the desiliconization becomes too large, so that even if the desiliconization is carried out at such a state that the whole amount of the slag dephosphorized at the previous charging is left in the converter type refining vessel 1, it is necessary to add a large amount of calcium oxide source (CaO based solvent) for further adjusting the basicity and also the slag amount in the converter type refining vessel 1 becomes excessive, which is not favorable in view of the refining cost and the like.

While, when the total amount of silicon is less than 4 kg/t, the amount of heat generation through the oxidation reaction of silicon is small, which is not effective for dissolving the cold iron source 14. When the total amount of silicon is 4~10 kg/t, it can be said to be a preferable range in view of not only the adjustment of the basicity after the desiliconization but also the securement of the heat source for dissolving the cold iron source 14.

In addition to the silicon source 8, the heat source required for dissolving the cold iron source 14 may utilize a carbonaceous material, ferrosilicon, metallic Al or the like as a part of the heat source.

In the dephosphorization after the desiliconization, it is necessary to control the temperature of the molten iron 4 to a proper range for efficiently conducting the dephosphorization. In this connection, by controlling the molten iron temperature after the desiliconization to not higher than 1320° C.

can be largely reduced a cooling material such as iron ore or the like added for temperature adjustment in the dephosphorization.

When the desiliconization and dephosphorization are continuously carried out in the same converter type refining vessel 1, the charging of the cold iron source 14 such as iron scraps through a chute before the dephosphorization is difficult in view of the operating time. Also, since the cold iron source 14 capable of being charged from the top of the converter during the treatment is expensive granulated ones or quantitatively limited ones such as scull or the like generated in ironworks, it is difficult to steadily use a large amount of such a source. In fact, it is common that the cold iron source 14 is not charged from the top of the converter with a top charging apparatus due to the restriction on the kind and number of the auxiliary material to be used.

In the dephosphorization, therefore, the cold iron source 14 capable of industrially being utilized in a large amount is limited to iron oxide such as iron ore or the like, and it is general that an inexpensive cold iron source 14 such as iron scraps or the like cannot be utilized sufficiently.

On the other hand, a large amount of inexpensive iron scraps is relatively easy to be used as a cold iron source 14 in the desiliconization, whereby the molten iron temperature after the desiliconization is controlled to not higher than 1320° C. As a result, the amount of iron oxide used in the dephosphorization can be reduced largely, and reaction heat by heat absorbing in the reduction of iron oxide can be indirectly utilized in the dissolution of the cold iron source 14 in the desiliconization.

When the molten iron temperature after the desiliconization is decreased, there is a fear that the cold iron source 14 remains at a molten state. However, the remaining cold iron source 14 is held in the converter type refining vessel 1 together with the molten iron 4 and the dissolution thereof is progressing during the subsequent dephosphorization, so that there is no problem in the operation as long as the dissolution of the cold iron source 14 is completed at the end of the dephosphorization.

In order to control the molten iron temperature after the desiliconization to a range of 1280~1320° C. while controlling the increase in the amount of the cold iron source 14 used and the refining cost, it is preferable that unit consumption of cold iron source $X_s$ (kg/t) per total mass of the cold iron source (iron scraps) 14 and the molten iron 4 is rendered into a range of not less than 220 but not more than 260 as a value of Y calculated by the following equation (1):

$$Y=(3+34.5[\%\ \mathrm{Si}]+0.21T_i)\cdot(1000-X_s)/1000 \quad (1)$$

wherein [% Si]: silicon concentration in molten iron charged (mass %), $T_i$: temperature of molten iron charged (° C.), $X_s$: unit consumption of cold iron source (kg/t).

When the value of Y is less than 220, it is necessary that the carbonaceous material such as amorphous graphite or the like is added as a heat source to prolong the refining time or an expensive heat source such as ferrosilicon or the like is added in a large amount, and also the CaO based solvent 10 is additionally used for adjusting the slag basicity, and hence the increase of the refining cost and the reduction of the productivity are caused, so that such a value is not desirable.

When the value of Y exceeds 260, a cooling material such as iron ore is used for controlling the temperature, so that such a value is not preferable from a viewpoint that the amount of the cold iron source 14 used is made maximum.

In the desiliconization suitable for the invention, the molten iron temperature after the desiliconization is controlled to a proper range and also silicon is used as a heat source, so that even if the cold iron source 14 is used in a large amount of 100~250 kg/t per total mass of the molten iron 4 and the cold iron source 14, the reduction of the productivity and the increase of the refining cost are not caused and the dissolution of the cold iron source 14 and the refining of the molten iron 4 can be conducted efficiently. However, when the unit consumption of the cold iron source exceeds 250 kg/t, there is a problem that additional heat source is required to cause the increase of the cost or the refining time is prolonged to reduce the productivity. And also, the further increase of the use amount is not efficient in view of restriction on the equipment charging the cold iron source.

In the invention, the slag removing ratio of the slag discharged from the converter type refining vessel 1 in the intermediate slag removal is not less than 30 mass % of the slag formed in the desiliconization.

Figure 7:
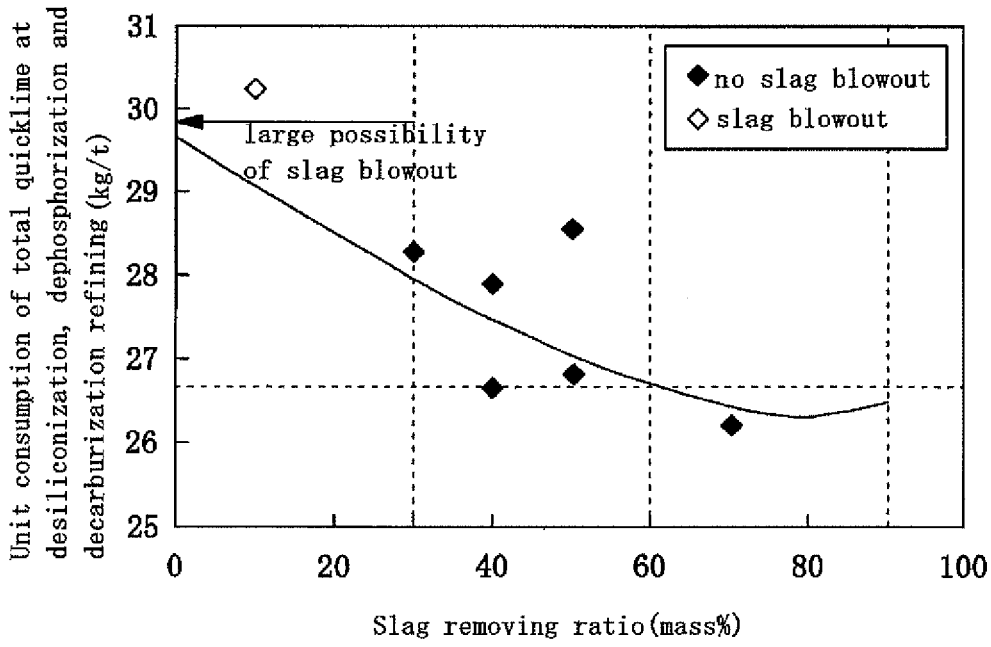
FIG. 7 is a graph showing a relation between unit consumption of quicklime at three steps of desiliconization, dephosphorization and decarburization refining and slag removing ratio.

Because, as shown in FIG. 7, when the slag removing ratio is less than 30 mass %, the amount of the CaO based solvent 10 used is increased in order to ensure the basicity of the slag (slag in the dephosphorization) for the purpose of preventing bad dephosphorization in the subsequent dephosphorization and consequently the slag amount becomes larger, so that the slag foaming cannot be controlled in the dephosphorization and slag blowout is caused at an outlet port of the converter type refining vessel 1 to generate operative troubles due to such a slag blowout.

In FIG. 7 is shown a relation between unit consumption of quicklime (CaO) at three steps of desiliconization, dephosphorization and decarburization refining and a slag removing ratio and the presence or absence of slag blowout is also shown.

A horizontal broken line in FIG. 7 (unit consumption of quicklime 26.7 kg/t) is an average unit consumption of quicklime from the desiliconization and dephosphorization (pretreatment) of molten iron to the decarburization refining in the converter according to the conventional technique. In the invention, the unit consumption of quicklime is made lower than the conventional one when the slag removing ratio of the slag is not less than 60 mass %.

In order to ensure minimum slag amount required at the dephosphorization step while avoiding the increase of the cost, the slag removing ratio of the slag is preferable to be 60~90 mass %. That is, it is effective to increase the slag removing ratio to not less than 60 mass % in order to suppress the total use amount of the CaO based solvent 10 consumed from the desiliconization and dephosphorization to the decarburization refining of the molten iron 4, while when the slag removing ratio of the resulting slag 16 exceeds 90 mass %, the slag formation of the CaO based solvent 10 newly added in the subsequent dephosphorization is damaged and there is a fear of obstructing the dephosphorization reaction. To this end, the slag removing ratio of the slag in the intermediate slag removal is preferably not more than 90 mass %.

In the invention, it is preferable that the amount of the slag 16 remaining in the converter type refining vessel 1 is controlled to not less than 4 kg/t but not more than 20 kg/t in the converter type refining vessel 1 after the completion of the intermediate slag removal. When the amount of the slag remaining in the converter type refining vessel 1 is less than 4 kg/t, it is required to use iron oxide for promoting the slag formation of the lime based solvent in the subsequent dephosphorization, while when it exceeds 20 kg/t, there is a problem that the amount of the lime based solvent used increases or the dephosphorization operation is obstructed.

Figure 8:
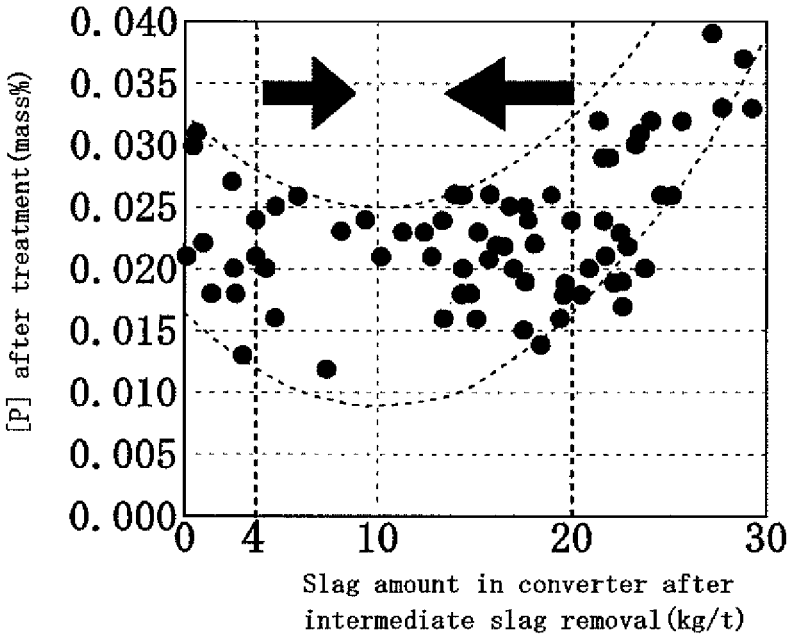
FIG. 8 is a graph showing a relation between slag amount in vessel during intermediate slag removal and phosphorus concentration after dephosphorization.

FIG. 8 is a graph showing an interrelation between an amount of the slag 16 remaining in the converter type refining vessel 1 after the intermediate slag removal and a phosphorus concentration in the molten iron after the dephosphorization. As seen from FIG. 8, when the amount of the slag 16 remaining in the converter type refining vessel 1 is small, it becomes inconvenient in the dissolution of the auxiliary material during the dephosphorization. On the other hand, when the remaining amount of the slag 16 is large, the amount of the auxiliary material used in the dephosphorization increases, and also the phosphorus concentration in the molten iron tends to be increased after the dephosphorization.

In order to promote the slag formation of the lime based solvent without using fluorite or iron oxide in the dephosphorization, it is effective to leave a proper amount of the slag in the converter type refining vessel 1 to utilize silicon dioxide or iron oxide in the remaining molten slag for the promotion of the slag formation. To this end, the slag is discharged from the converter type refining vessel 1 in the intermediate slag removal by adjusting an inclination angle of the converter so that the slag of 4~20 kg/t is left in the converter type refining vessel 1.

Thus, it is possible to efficiently promote the dephosphorization reaction without using iron oxide in the dephosphorization, and reaction heat by heat absorption in the reduction of iron oxide can be indirectly utilized as a heat source for dissolving the cold iron source in the desiliconization.

In order to increase the slag removing property of the slag in the intermediate slag removal, it is effective to conduct the foaming of the slag in the converter type refining vessel 1. To this end, it is required to increase the rate of CO gas generation by the reaction of carbon included in the molten iron 4 with oxygen.

When the slag 16 is discharged by adjusting the inclination angle of the converter type refining vessel 1 in order to prevent the flow of the molten iron 4, it is inevitable that a certain amount of the slag 16 is left in the converter type refining vessel 1, but since an actual ratio of the foaming slag 16 is about 1/10 and a bulk specific gravity is considerably lowered as compared with a true specific gravity, the amount of the slag 16 remaining in the converter type refining vessel 1 can be controlled to a low level. Here, when a slag specific density not foaming is a true specific gravity and a slag specific gravity in the foaming is a bulk specific gravity, the actual ratio is defined by (bulk specific gravity/true specific gravity).

Figure 9:
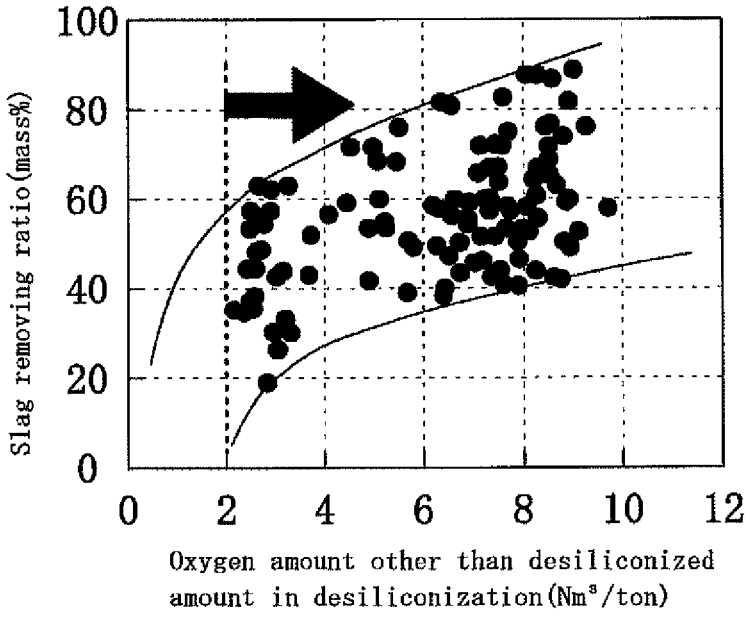
FIG. 9 is a graph showing a relation between oxygen amount other than desiliconized amount in desiliconization and slag removing ratio.

FIG. 9 is a graph showing a relation between an oxygen amount other than an amount of oxygen required for oxidizing silicon included in the molten iron 4 and a slag removing ratio of the slag. Moreover, "oxygen amount other than desiliconized amount" in the desiliconization represented in a horizontal axis of FIG. 9 means an oxygen amount other than oxygen used in the oxidation of Si in molten iron, SiC briquette as a heat rising material and non-oxidizing silicon. As shown in FIG. 9, when oxygen other than the oxygen required for oxidizing silicon in the molten iron during the desiliconization is supplied to the molten iron 4, the slag removing ratio varies depending upon the oxygen amount. In order to ensure the target slag removing ratio, it is preferable that an amount of oxygen supplied to the molten iron 4 other than oxygen required for oxidizing silicon in the molten iron during the desiliconization is not less than 2 $Nm^3/t$, more desirably not less than 4 $Nm^3/t$ as a unit consumption per total mass of the molten iron 4 and the cold iron source 14 charged into the converter type refining vessel 1. Moreover, the upper limit of such an oxygen amount is desirable to be about 10 $Nm^3/t$ from a viewpoint of preventing excessive decarburization to suppress the decrease of carbon concentration in the molten iron as a heat source for the subsequent decarburization.

Figure 10:
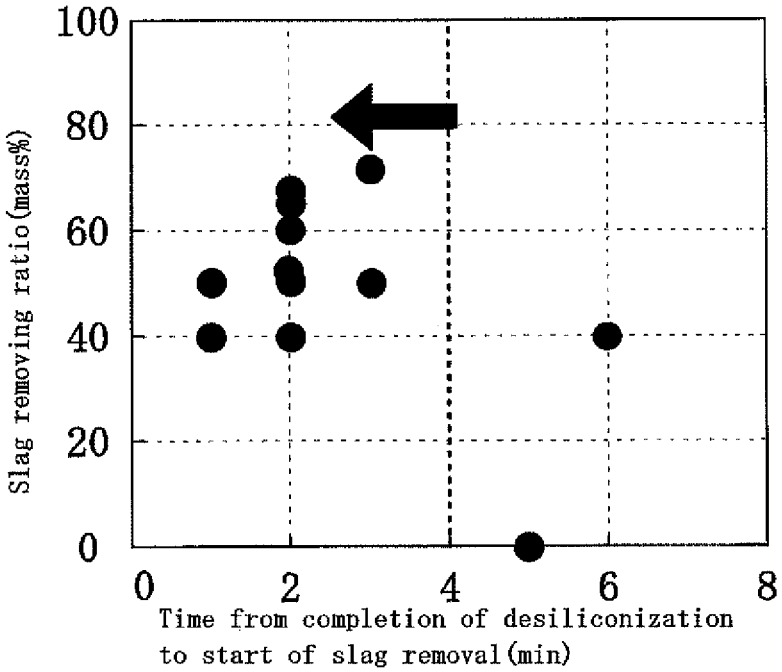
FIG. 10 is a graph showing a relation between a time from completion of desiliconization to start of slag removal and slag removing ratio.

Since the slag removing ratio is considerably decreased when the foaming of the slag is calmed down, a time from the completion of desiliconization to the slag removal is preferable to be within 4 minutes as shown in FIG. 10.

After the intermediate slag removal, the CaO based solvent 10 and oxygen source are supplied to the molten iron 4 remaining in the converter type refining vessel to conduct dephosphorization of the molten iron 4 as shown in FIG. 2(*d*). As the oxygen source used in the dephosphorization, it is preferable to use an oxygen gas from a top blowing lance 2. Since the invention is to dissolve the large amount of the cold iron source 14, it is not preferable to use iron oxide absorbing heat in the temperature rise and decomposition as an oxygen source. When the basicity of the slag 16 produced in the desiliconization is not less than 1.5, dephosphorization reaction progresses. In this case, it is not required to newly add the CaO based solvent 10 at the dephosphorization step.

Phosphorus in the molten iron is oxidized with oxygen in the oxygen source to form a phosphorus oxide ($P_2O_5$). The phosphorus oxide is incorporated into the slag, which is formed by the slag formation of the CaO based solvent 10 and functions as a dephosphorization refiner, as a stable compound of $3CaO.P_2O_5$ to progress the dephosphorization reaction of the molten iron 4.

When the dephosphorization reaction is progressed to reduce phosphorus concentration in the molten iron to a given value, as shown in FIG. 2(*e*), the dephosphorization is completed and the converter type refining vessel 1 is tilted toward a side provided with a tapping port 13 to tap the molten iron 4 inside the converter type refining vessel 1 to a molten iron keeping vessel (not shown) (tapping step).

The refining of the molten iron according to the invention is carried out as mentioned above.

Figure 11:
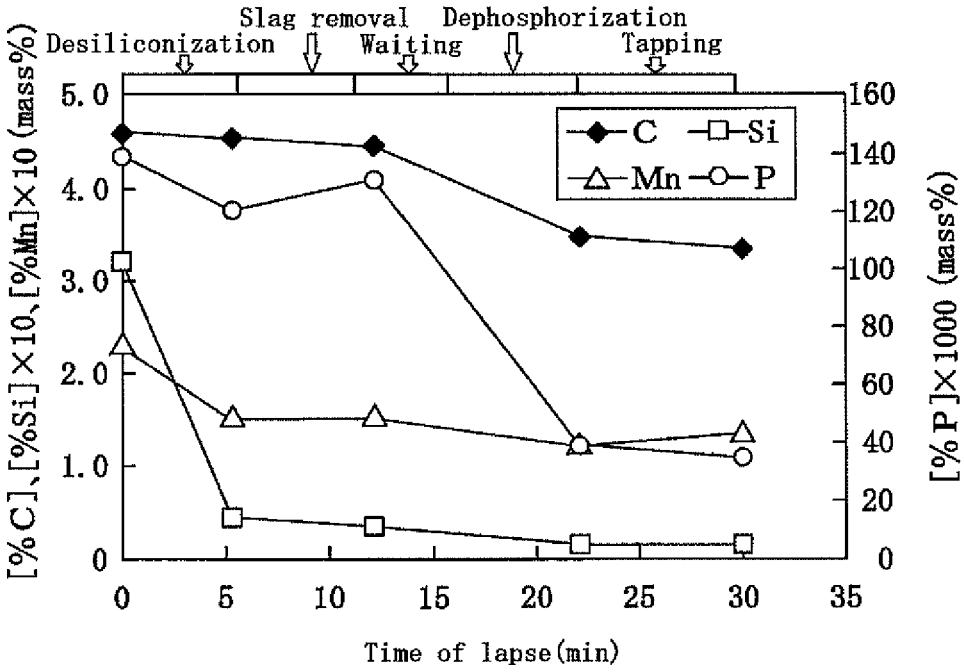
FIG. 11 is a graph showing an example of transitions of silicon concentration, carbon concentration, phosphorus concentration and manganese concentration in molten iron over a period from desiliconization to tapping.

FIG. 11 is a graph showing an example of transitions of silicon concentration, carbon concentration, phosphorus concentration and manganese concentration in molten iron over a period from desiliconization step to tapping step when applying the invention. As shown in FIG. 11, according to the invention, combustion heat of silicon included in the silicon-containing material (silicon source) added to the molten iron during the desiliconization is positively utilized as a thermal compensation method for the dissolution of the cold iron source such as iron scraps or the like, and the desiliconization and dephosphorization are continuously conducted to the molten iron across the slag removing step (intermediate slag removal) with the converter type refining vessel, so that it is realized to efficiently dissolve the large amount of the cold iron source in a short time.

The desiliconization has hitherto been carried out as a non-continuous pretreatment of the molten iron. In this case, iron oxide was supplied as an oxygen source in the conventional desiliconization for the purpose of avoiding operation troubles due to the slag foaming in the molten iron vessel and at the same time supplying the large amount of oxygen in a short time. In the method of blowing iron oxide mainly as an oxygen source for desiliconization into the molten iron at an initial desiliconization stage in the pretreatment of the molten iron as described, for example, in Patent Document 3, the temperature rise of the molten iron at the desiliconization stage is not obtained sufficiently.

Thus, the iron oxide is decomposed and absorbs heat in the conventional desiliconization, so that combustion heat of silicon in the molten iron cannot be efficiently converted into heat for dissolving the cold iron source. In the invention, the desiliconization is carried out in the converter type refining vessel 1 and there is a room in the vessel volume, so that it is possible to supply a large amount of gaseous oxygen to the molten iron 4 in a short time without using the iron oxide, and also it is possible to utilize combustion heat of silicon for dissolving the cold iron source 14 without being used as a decomposition heat for the iron oxide. Further, according to the invention, the dephosphorization is continuously carried out after the desiliconization, a heat discharge amount associated with translocation of the refining vessel can be utilized as a heat for dissolving the cold iron source.

Since the slag with a low basicity produced in the desiliconization is discharged out from the converter type refining vessel 1 between the desiliconization and the dephosphorization, it is possible to reduce the amount of CaO based solvent 10 used in the dephosphorization requiring a high basicity (=1.5~3.0).

Also, according to the invention, converter slag and ladle slag, which are difficult to be scraped as a sub-base course material because of high basicity, can be utilized as a CaO based solvent 10 for adjusting the basicity of the slag in the desiliconization. The converter slag and the ladle slag are reproduced as a slag having a low basicity after the desiliconization, so that it is possible to scrap the converter slag and the ladle slag. The utilization of the converter slag and the ladle slag can promote the slag formation sufficiently even in the desiliconization for a short time, so that the increase of the slag removing ratio is attained.

Furthermore, according to the invention, when the auxiliary material containing silicon carbide as a main component is used as a silicon-containing material (silicon source) charged into the converter in the desiliconization, or concretely when using SiC briquette containing SiC as a main component and/or SiC based waste refractory containing SIC as a main component, a greater amount of heat can be compensated inexpensively and efficiently. The silicon-containing material is preferable to have a silicon carbide content of not less than 30 mass %.

In this connection, the addition amount of SiC briquette and SiC based waste refractory is preferable to be not more than an upper addition limit W calculated by the following equation (2):

$$W=(F-600)\times 0.3\div 22.4\times 28\div X_{si}+10 \quad (2)$$

wherein W: an upper addition limit of SiC briquette and/or SiC based waste refractory (ton), F: total amount of transmitted oxygen during desiliconization ($Nm^3$), $X_{si}$: Si content included as SiC in SIC briquette or SiC based waste refractory (mass %).

Moreover, the upper addition limit W is a total of values calculated on the SiC briquette and the SiC based waste refractory, respectively.

Figure 12:
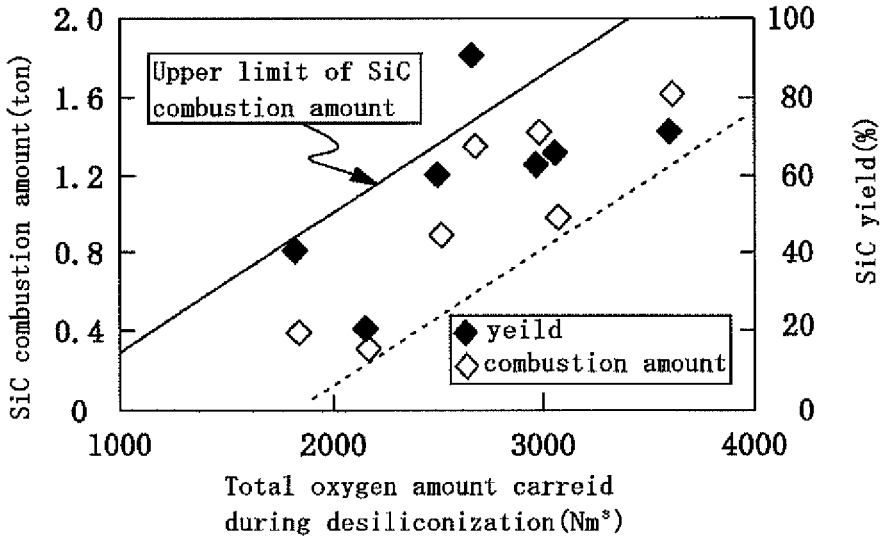
FIG. 12 is a graph showing a relation among total amount of transmitted oxygen during desiliconization, SiC combustion amount and SiC yield.

FIG. 12 is a graph showing a relation among a total amount of transmitted oxygen during the desiliconization, a SiC combustion amount and a SiC yield. As seen from FIG. 12, there is an upper limit in the SiC amount acted as a heat source depending upon the total amount of transmitted oxygen during the desiliconization (amount of oxygen used in the desiliconization), and it is possible to compensate stable heat amount more efficiently by avoiding heat lacking and cost increase due to the occurrence of large amount of unreacted SiC.

EXAMPLES

Example 1

A pretreatment of molten iron is carried out using a converter type refining vessel of 250 t in capacity having a construction as shown in FIG. 1 in a way shown in FIGS. 2(*a*)~(*e*), during which processing status is investigated. The results are shown in Table 1.

In Example 1, top blowing is carried out by blowing an oxygen gas 3 into a molten iron 4 with a top blowing lance 2, while bottom blowing is carried out by blowing a nitrogen gas into the molten iron with five bottom blowing tuyeres 5 disposed in the bottom of the converter type refining vessel 1. In the refining of the molten iron 4, a cold iron source 14 is first charged into the converter type refining vessel 1, and thereafter the molten iron 4 is charged, and then a silicon source and CaO based solvent are charged to start desiliconization.

As a silicon source being a heat source in the desiliconization is used SiC briquettes containing 52.5 mass % of Si as SiC, and also a carbonaceous material is used together with the SiC briquettes in a part of the operation (Invention Example 2). After the desiliconization, a slag removing operation is conducted rapidly and subsequently dephosphorization is conducted. A time from a start of the desiliconization through the dephosphorization to the completion of the tapping is about 30 minutes likewise FIG. 11. As the cold iron source is used iron scrap defined in "Uniform standards of ferrous scraps" of The Japan ferrous raw materials association.

TABLE 1

| | | Invention Example | | | | Comparative Example | |
|---|---|---|---|---|---|---|---|
| | Items | 1 | 2 | 3 | 4 | 1 | 2 |
| Charging | Amount of molten iron (t) | 212.5 | 212.5 | 212.5 | 212.5 | 212.5 | 230.0 |
| | Molten iron temperature (° C.) | 1270 | 1221 | 1240 | 1238 | 1245 | 1250 |
| | C in molten iron (mass %) | 4.6 | 4.6 | 4.6 | 4.6 | 4.6 | 4.6 |
| | Si in molten iron (mass %) | 0.29 | 0.24 | 0.24 | 0.24 | 0.35 | 0.73 |
| | P in molten iron (mass %) | 0.123 | 0.125 | 0.127 | 0.122 | 0.123 | 0.124 |
| | Amount of iron scraps charged (t) | 37.5 | 37.5 | 37.5 | 37.5 | 37.5 | 20.0 |
| | value of Y | 238 | 228 | 231 | 231 | 235 | 267 |
| Desiliconization | Amount of SiC briquettes charged (t) | 1.3 | 1.8 | 1.6 | 1.3 | 1.8 | 0 |
| | Amount of non-oxide silicon (kg/t) | 4.6 | 5.1 | 4.7 | 4.2 | 6.0 | 6.7 |
| | Amount of carbonaceous material charged (t) | — | 1.6 | — | — | — | — |
| | Amount of quicklime charged (kg/t) | 8.4 | 8.2 | 6.0 | 4.8 | 10.9 | 12.1 |

TABLE 1-continued

| | Items | Invention Example 1 | 2 | 3 | 4 | Comparative Example 1 | 2 |
|---|---|---|---|---|---|---|---|
| | Amount of converter slag charged (kg/t) | — | 12 | 8 | — | — | — |
| | Amount of oxygen for other than desiliconizatione ($Nm^3$/t) | 5.3 | 11.7 | 6.4 | 6.8 | 7.7 | 6.9 |
| | Molten iron temperature after treatment | 1327 | 1320 | 1295 | 1280 | 1302 | 1396 |
| Intermediate slag removal | Slag basicity | 0.80 | 1.00 | 0.80 | 0.50 | 0.80 | 0.80 |
| | Waiting time before slag removal (min) | 1 | 1 | 2 | 1 | no slag removal | 1 |
| | Slag inside converter after slag removal (kg/t) | 8 | 11 | 14 | 14 | 34 | 8 |
| | Slag removing ratio (%) | 70 | 70 | 50 | 30 | 0 | 78 |
| Dephosphorization | Amount of quicklime charged (kg/t) | 2.4 | 3.0 | 4.0 | 6.0 | 8.0 | 3.0 |
| | Amount of transmitted oxygen ($Nm^3$) | 4000 | 5700 | 4300 | 4300 | 4750 | 4500 |
| | Amount of iron ore (kg/t) | 0 | 0 | 0 | 0 | 0 | 20 |
| | Scrap not dissolved | none | none | slight | presence | none | none |
| | Slag blowout | none | none | none | none | none | none |
| | Bottom blowing amount ($Nm^3$/hr) | 2100 | 2100 | 2100 | 2100 | 2100 | 2100 |
| | Molten iron temperature after treatment (° C.) | 1365 | 1356 | 1352 | 1354 | 1375 | 1387 |
| After treatments | C in molten iron (mass %) | 3.0 | 3.0 | 3.0 | 3.0 | 3.0 | 2.9 |
| | Si in molten iron (mass %) | 0.01 | 0.01 | 0.01 | 0.01 | 0.01 | 0.01 |
| | P in molten iron (mass %) | 0.029 | 0.027 | 0.028 | 0.029 | 0.027 | 0.032 |
| | Total amount of quicklime (kg/t) | 10.8 | 11.2 | 10.0 | 10.8 | 18.9 | 15.1 |

The amount of transmitted oxygen in the dephosphorization item of Table 1 shows a total amount in desiliconization and dephosphorization. In Invention Examples 1~4, SiC briquettes alone or SiC briquettes and carbonaceous material are charged before the desiliconization and the slag removing operation is conducted immediately after the desiliconization and subsequently the dephosphorization is conducted.

Invention Example 1 is a case that the molten iron temperature in the intermediate slag removal is 1327° C., and Invention Example 2 is a case that the molten iron temperature in the intermediate slag removal is 1320° C. In either examples, the slag removing ratio is as high as about 70% and also all of the iron scraps is dissolved.

Invention Examples 3 and 4 are a case that the molten iron temperature (slag temperature) is 1295° C. and 1280° C., respectively. The molten iron temperature is lower than those of Invention Examples 1 and 2, and as the temperature is lowered, the slag removing ratio is decreased. It is clear that even when the basicity of the slag is 0.5 as in Invention Example, 4, if the molten iron temperature is not lower than 1280° C., the slag removing ratio of about 30% can be ensured.

In Comparative example 1, the silicon source is added likewise Invention Examples 1~4, and then the dephosphorization is carried out without conducting the intermediate slag removal. It can be seen that Comparative Example 1 tends to increase the amount of quicklime used different from Invention Examples 1~4 conducting the intermediate slag removal.

Comparative Example 2 is a case that the molten iron temperature after the completion of the desiliconization is made to about 1396° C. by adjusting the amount of scraps used. In Comparative Example 2, it is clear that a large amount of iron ore (20 kg/t) should be used for temperature adjustment in the dephosphorization.

From the above results, it has been confirmed that in the refining method of the molten iron according to the invention, combustion heat of silicon can be used effectively for dissolving the scraps while suppressing the refining cost.

Example 2

The pretreatment of the molten iron according to the invention is carried out using the converter type refining vessel likewise Example 1. An oxygen gas is blown into the molten iron through the top blowing lance 2, while a nitrogen gas for agitation is blown into the molten iron through seven bottom blowing tuyeres 5 disposed in the bottom of the converter, whereby the pretreatment is conducted. In all operations, the cold iron source is first charged into the converter type refining vessel 1 and thereafter the molten iron is charged and then the silicon source and CaO based solvent are charged to start desiliconization. As the silicon source being a heat source in the desiliconization is used SiC briquettes containing 52.5 mass % of Si as SIC, and the carbonaceous material is used together with the SiC briquettes in a part of the operations. After the desiliconization, the slag removing operation is conducted immediately and subsequently the dephosphorization is conducted. The time from the start of the desiliconization through the dephosphorization to the completion of the tapping is about 30 minutes likewise FIG. 11. As the cold iron source is used iron scrap defined in "Uniform standards of ferrous scraps" of The Japan ferrous raw materials association.

In Table 2 are shown operation conditions and operation results of Invention examples applying the invention and Comparative Examples for the comparison. In any operations, iron oxide is not used during the desiliconization, but the basicity of the slag discharged from the converter type refining vessel is reached to a target value at the slag removing step after the desiliconization and the slag is sufficiently formed.

TABLE 2

| | | | Invention Example | | | | | | Comparative |
|---|---|---|---|---|---|---|---|---|---|
| | Items | | 5 | 6 | 7 | 8 | 9 | 10 | Example 3 |
| Iron source | Molten iron | Amount charged (t) | 212.5 | 212.5 | 212.5 | 212.5 | 212.5 | 212.5 | 212.5 |
| | | Temperature (° C.) | 1270 | 1221 | 1240 | 1238 | 1255 | 1223 | 1225 |
| | | Ingredient (mass %) C | 4.6 | 4.6 | 4.6 | 4.6 | 4.6 | 4.6 | 4.6 |
| | | Si | 0.29 | 0.24 | 0.24 | 0.24 | 0.26 | 0.27 | 0.26 |
| | | P | 0.123 | 0.125 | 0.127 | 0.122 | 0.120 | 0.125 | 0.130 |
| | Amount of iron scraps charged (t) | | 37.5 | 37.5 | 37.5 | 37.5 | 37.5 | 37.5 | 37.5 |
| Desiliconization | Amount of SiC briquettes charged (t) | | 1.3 | 1.8 | 1.4 | 1.3 | 1.4 | 2.3 | 1.4 |
| | SiC combustion amount (t) | | 1.1 | 1.8 | 1.2 | 1.2 | 1.3 | 1.7 | 1.3 |
| | SiC yield (%) | | 85 | 100 | 86 | 92 | 93 | 74 | 93 |
| | Amount of carbonaceous material charged (t) | | — | 1.6 | — | — | — | — | — |
| | W (t) | | 1.36 | 2.14 | 1.29 | 1.36 | 1.43 | 2.14 | 1.36 |
| | Amount of quicklime charged (kg/t) | | 10.6 | 8.6 | 8.6 | 4.8 | 13.8 | 9.2 | 6.8 |
| | Amount of converter slag charged (kg/t) | | — | 12.0 | 12.0 | — | 12.0 | 12.0 | 12.0 |
| | Total amount of transmitted oxygen ($Nm^3$) | | 2500 | 3600 | 2400 | 2500 | 2600 | 3600 | 2500 |
| | Molten iron temperature after treatment (° C.) | | 1327 | 1320 | 1295 | 1280 | 1330 | 1310 | 1275 |
| Intermediate slag removal | Slag basicity | | 1.1 | 1.0 | 1.0 | 0.5 | 1.5 | 1.2 | 1.0 |
| | Waiting time before slag removal (min) | | 1 | 1 | 2 | 1 | 2 | 1 | 1 |
| | Slag removing ratio (mass %) | | 70 | 70 | 50 | 30 | 30 | 40 | 20 |
| Dephosphorization | Amount of quicklime charged (kg/t) | | 2.4 | 3.0 | 4.0 | 8.0 | 0 | 5.0 | 4.0 |
| | Total amount of transmitted oxygen ($Nm^3$) | | 4000 | 5700 | 4300 | 4300 | 4100 | 4400 | 4000 |
| | Iron scrap not dissolved | | none | none | slight | presence | none | none | presence |
| | Slag blowout | | none | none | none | none | none | none | presence |
| | Bottom blowing amount ($Nm^3$/hr) | | 2100 | 2100 | 2100 | 2100 | 2100 | 2100 | 2100 |
| | Molten iron temperature after treatment (° C.) | | 1365 | 1356 | 1352 | 1354 | 1370 | 1350 | 1374 |
| After tapping | Ingredient of molten iron (mass %) | C | 3.0 | 3.0 | 3.0 | 3.0 | 3.0 | 2.8 | 3.0 |
| | | Si | 0.01 | 0.01 | 0.01 | 0.01 | 0.01 | 0.01 | 0.01 |
| | | P | 0.029 | 0.027 | 0.028 | 0.029 | 0.028 | 0.028 | 0.031 |

In Invention Examples 5 and 6, the molten iron temperature in the completion of the desiliconization is not lower than 1320° C. or the slag temperature in the intermediate slag removal is not lower than 1320° C., and the slag basicity is 1.0~1.1 and the viscosity of the slag is low, so that the high slag removing ratio of 70 mass % is obtained. Also, the iron scraps are completely dissolved in Invention Examples 5, 6, 9 and 10.

In Invention Examples 7 and 8, the slag removing ratio is decreased with the lowering of the slag temperature in the intermediate slag removal. However, even when the basicity is 0.5 as in Invention Example 8, if not lower than 1280° C. is ensured as a molten iron temperature in the completion of the desiliconization, the slag removing ratio of 30 mass % can be ensured. Also, it has been confirmed that the slag blowout is not caused in the outlet port of the converter though $SiO_2$ amount of the slag in the converter during the dephosphorization reaches 2.5 kg/t at maximum in the subsequent dephosphorization.

However, the iron scrap is not partly dissolved in Invention Examples 7 and 8 because the transition of the molten iron temperature is low through the desiliconization and dephosphorization. That is, when the molten iron temperature in the completion of the desiliconization is not lower than 1280° C., the slag removing ratio of not less than 30 mass % can be ensured, but when the molten iron temperature in the completion of the desiliconization is lower than 1320° C., it can be seen that the possibility not dissolving the iron scrap is high.

In Invention Example 9, although the molten iron temperature in the completion of the desiliconization is as high as 1330° C., the slag basicity is as high as 1.5 and the viscosity of the slag is high, so that the slag removing operation is difficult, but the slag removing ratio of 30 mass % can be ensured.

In Invention Example 10, although SiC briquettes are added in an amount larger than the upper addition limit (W) of SiC briquette and/or SiC based waste refractory calculated by the equation (2) with respect to the total amount of transmitted oxygen in the desiliconization, the excessive addition fraction does not act as a heat source, so that the end temperature in the desiliconization becomes somewhat low or it is difficult to control the molten iron temperature in the intermediate slag removal and also the wasteful increase of the cost is caused.

In Comparative Example 3, the slag basicity is 1.0, whereas the molten iron temperature in the completion of the desiliconization is lower than 1280° C. and the slag removing ratio stays in 20 mass %. Also, in Comparative Example 3, the amount of the slag carried over to the dephosphorization becomes large, and the slag blowout is caused in the outlet port of the converter during the dephosphorization. From this fact, it is confirmed that it is particularly effective to ensure 1280° C. as the molten iron temperature in the completion of the desiliconization.

In Table 2, SiC combustion amount means a difference between SiC briquette amount added to the converter during the desiliconization and SiC briquette amount remaining in the slag after the desiliconization as it is not reacted, and SiC yield means a ratio of SiC combustion amount to SiC briquette amount added to the converter.

In Table 3 is shown a comparison between chemical composition of the converter slag used in the desiliconization of Invention Example 6 and chemical composition of the slag taken out in the intermediate slag removal of Invention Example 6. As seen from Table 3, the converter slag having a basicity of about 4 can be modified to a low-basicity slag having a basicity of 1.0 by using the converter slag as a material adjusting the slag basicity in the desiliconization. According to the invention, it can be confirmed that the converter slag of a high basicity being difficult in the material utilization can be modified to a slag of a low basicity being easy in the material utilization.

TABLE 3

| | Chemical composition of slag (mass %) | | | | | |
|---|---|---|---|---|---|---|
| | T. Fe | $SiO_2$ | CaO | $Al_2O_3$ | MgO | MnO |
| Converter slag | 25.8 | 10.1 | 40.5 | 1.9 | 7.1 | 4.3 |
| Slag removed after desiliconization | 17.0 | 33.2 | 33.4 | 2.0 | 1.5 | 3.0 |

DESCRIPTION OF REFERENCE SYMBOLS

1 converter type refining vessel
2 top blowing lance
3 oxygen gas
4 molten iron
5 bottom blowing tuyere
6 gas for bottom blowing tuyere
7 hopper
8 silicon-containing material (silicon source)
9 hopper
10 auxiliary material containing CaO as a main component (CaO based solvent)
11 chute
12 chute
13 tapping port
14 cold iron source
15 charging ladle
16 slag

INDUSTRIAL APPLICABILITY

According to the invention can be provided a refining method capable of efficiently refining molten iron while keeping a compounding ratio of a cold iron source such as iron scraps or the like in a high level.

The invention claimed is:

1. A method of refining molten iron, the method comprising:

charging molten iron and a cold iron source into a converter refining vessel;

supplying or charging an auxiliary material containing CaO as a main component to the converter refining vessel;

supplying a first oxygen source and a first silicon-containing material or a combination of a silicon-containing material and a carbonaceous material to the converter refining vessel as a heat source to dissolve the cold iron source and conduct desiliconization of the molten iron;

removing at least a part of slag produced by the desiliconization as an intermediate slag removal; and subsequently supplying a slag-forming agent and a second oxygen source to the molten iron in the converter refining vessel to conduct dephosphorization, wherein the desiliconization is carried out under conditions such that a basicity of the slag after desiliconization is in the range of 0.5 to 1.5, where basicity: mass % CaO/mass % $SiO_2$, a molten iron temperature after the desiliconization in the range of 1280° C. to 1350° C., and not less than 30 mass % of the slag produced in the desiliconization is removed from the converter refining vessel in the intermediate slag removal.

2. The method of refining molten iron according to claim 1, wherein an addition amount of at least one of the auxiliary material containing CaO as a main component and the first silicon-containing material is adjusted so as to render the basicity of the slag after the desiliconization in the range of 0.5 to 1.0.

3. The method of refining molten iron according to claim 1, wherein an amount of the second oxygen source supplied is adjusted to regulate the molten iron temperature after the desiliconization to not lower than 1320° C.

4. The method of refining molten iron according to claim 1, wherein the molten iron charged into the converter refining vessel include a second silicon-containing material, and a total amount of non-oxide silicon in the first and second silicon-containing materials is in the range of 4 to 10 kg/t per total mass of the molten iron and cold iron source charged into the converter refining vessel.

5. The method of refining molten iron according to claim 1, wherein a a value Y is in the range of 220 to 260, where Y is calculated according to equation (1):

$$Y=(3+34.5[\%\ Si]+0.21T_i)\cdot(1000-X_s)/1000 \quad (1)$$

where [% Si]: concentration of silicon in molten iron charged (mass %), $T_i$: temperature of molten iron charged (° C.), and $X_s$: unit consumption of cold iron source (kg/t) of the cold iron source per total ma of the cold iron source and molten iron charged into the converter refining vessel.

6. The method of refining molten iron according to claim 1, wherein a slag removing ratio of the slag removed from the converter refining vessel in the intermediate slag removal is in the range of 60 to 90 mass % of the slag produced in the desiliconization.

7. The method of refining molten iron according to claim 1, wherein a slag amount of the slag remaining in the converter refining vessel after the intermediate slag removal is in the range of 4 to 20 kg/t.

8. The method of refining molten iron according to claim 1, wherein an amount of oxygen supplied to the molten iron other than oxygen consumed for oxidation of silicon in the desiliconization is not less than 2 $Nm^3$/t as a unit consumption per total mass of the molten iron and cold iron source charged into the converter refining vessel.

9. The method of refining molten iron according to claim 1, wherein the cold iron source is at least one of iron scrap, direct reduced iron and cold iron.

10. The method of refining molten iron according to claim 1, wherein the desiliconized slag is removed not more than 4 minute after the desiliconization.

11. The method of refining molten iron according to claim 1, wherein the auxiliary material containing CaO as a main component supplied in the desiliconization is at least one of a converter slag and a ladle slag.

12. The method of refining molten iron according to claim 1, wherein the first silicon-containing material is composed mainly of silicon carbide.

13. The method of refining molten iron according to claim 12, wherein the first silicon-containing material composed mainly of silicon carbide is at least one of SiC briquette and SiC based waste refractory containing silicon carbide as a main component.

14. The method of refining molten iron according to claim 13, further comprising determining an addition amount W of the at least one of SiC briquette and SiC based waste refractory, where the upper addition limit W is calculated according to equation (2):

$$W=(F-600)\times 0.3\div 22.4\times 28\div X_{si}\div 10 \quad (2)$$

wherein W: upper limit of addition amount of the at least one of SiC briquette and SiC based wasted material (ton), F: total amount of transmitted oxygen in desiliconization ($Nm^3$), and $X_{si}$: Si content (mass %) contained as SiC in the at least one of SiC briquette and SiC based waste refractory.

* * * * *